US009278430B2

(12) United States Patent
Hoang et al.

(10) Patent No.: US 9,278,430 B2
(45) Date of Patent: Mar. 8, 2016

(54) ABRASIVE ARTICLE INCORPORATING AN INFILTRATED ABRASIVE SEGMENT

(71) Applicants: SAINT-GOBAIN ABRASIVES, INC., Worcester, MA (US); SAINT-GOBAIN ABRASIFS, Conflans-Sainte-Honorine (FR)

(72) Inventors: Marc L. Hoang, Thionville (FR); Ignazio Gosamo, Léglise-Thibessart (BE); André R. G. Heyen, Malmedy (BE)

(73) Assignees: SAINT-GOBAIN ABRASIVES, INC., Worcester, MA (US); SAINT-GOBAIN ABRASIFS (FR)

( * ) Notice: Subject to any disclaimer, the term of this patent is extended or adjusted under 35 U.S.C. 154(b) by 58 days.

(21) Appl. No.: 14/079,258

(22) Filed: Nov. 13, 2013

(65) Prior Publication Data

US 2014/0069023 A1 Mar. 13, 2014

Related U.S. Application Data

(63) Continuation of application No. 12/983,075, filed on Dec. 31, 2010, now Pat. No. 8,597,088.

(60) Provisional application No. 61/291,785, filed on Dec. 31, 2009.

(51) Int. Cl.

| | |
|---|---|
| ***B24B 7/00*** | (2006.01) |
| ***B24D 3/06*** | (2006.01) |
| ***B24D 3/10*** | (2006.01) |
| ***B24D 7/06*** | (2006.01) |
| ***B28D 1/12*** | (2006.01) |

(52) U.S. Cl.

CPC .. *B24D 3/06* (2013.01); *B24D 3/10* (2013.01); *B24D 7/06* (2013.01); *B28D 1/12* (2013.01)

(58) Field of Classification Search

CPC ..... B24D 3/309; B24D 3/06
USPC ..... 451/540–558; 51/296; 428/660, 666, 428/673, 674, 678, 686

See application file for complete search history.

(56) References Cited

U.S. PATENT DOCUMENTS

| | | | |
|---|---|---|---|
| 1,676,887 | A | 7/1928 | Chamberlin |
| 1,949,513 | A | 3/1934 | Greenwood |

(Continued)

FOREIGN PATENT DOCUMENTS

| | | | |
|---|---|---|---|
| CN | 87208852 | U | 12/1987 |
| CN | 1040535 | A | 3/1990 |

(Continued)

OTHER PUBLICATIONS

Norton, "Silencio" Clipper, 2009, pp. 26-27.

(Continued)

*Primary Examiner* — Dung Van Nguyen

(74) *Attorney, Agent, or Firm* — Abel Law Group, LLP; Joseph P. Sullivan

(57) ABSTRACT

An abrasive article includes a base, an abrasive member comprising three distinct phases bonded to each other including abrasive particles, a metal matrix, and an infiltrant. The abrasive article further includes a backing region between the abrasive member and the base, wherein the backing region comprises a laser welded bond joint.

20 Claims, 4 Drawing Sheets

(56) References Cited

U.S. PATENT DOCUMENTS

| | | | |
|---|---|---|---|
| 1,954,330 | A | 4/1934 | Schurr |
| 3,088,251 | A | 5/1963 | Davis |
| 3,590,535 | A | 7/1971 | Benson et al. |
| 3,594,141 | A | 7/1971 | Houston et al. |
| 3,613,472 | A | 10/1971 | Held |
| 3,777,443 | A | 12/1973 | Shaw |
| 3,850,590 | A | 11/1974 | Chalkley et al. |
| 3,955,324 | A | 5/1976 | Lindstrom |
| 4,155,721 | A | 5/1979 | Fletcher |
| 4,208,154 | A | 6/1980 | Gundy |
| 4,224,380 | A | 9/1980 | Bovenkerk et al. |
| 4,397,555 | A | 8/1983 | Malcolm et al. |
| 4,453,484 | A | 6/1984 | Englund |
| 4,689,919 | A | 9/1987 | Kawakita et al. |
| 4,925,457 | A | 5/1990 | deKok et al. |
| 4,931,363 | A | 6/1990 | Slutz et al. |
| 4,977,710 | A | 12/1990 | Une |
| 5,000,273 | A | 3/1991 | Horton et al. |
| 5,049,165 | A | 9/1991 | Tselesin |
| 5,074,080 | A | 12/1991 | Erhardt et al. |
| 5,082,070 | A | 1/1992 | Obermeier et al. |
| 5,092,910 | A | 3/1992 | deKok et al. |
| 5,127,197 | A | 7/1992 | Brukvoort et al. |
| 5,127,923 | A | 7/1992 | Bunting et al. |
| 5,190,568 | A | 3/1993 | Tselesin |
| D342,270 | S | 12/1993 | Kwang |
| 5,380,390 | A | 1/1995 | Tselesin |
| 5,385,591 | A | 1/1995 | Ramanath et al. |
| 5,505,750 | A | 4/1996 | Andrews |
| 5,507,686 | A | 4/1996 | Wolters |
| 5,518,443 | A | 5/1996 | Fisher |
| 5,718,736 | A | 2/1998 | Onishi et al. |
| 5,791,330 | A | 8/1998 | Tselesin |
| 5,817,204 | A | 10/1998 | Tselesin |
| 5,865,571 | A | 2/1999 | Tankala et al. |
| 5,868,125 | A | 2/1999 | Maoujoud |
| 5,906,245 | A | 5/1999 | Tibbitts et al. |
| 5,932,508 | A | 8/1999 | Armstrong et al. |
| 5,980,678 | A | 11/1999 | Tselesin |
| 6,009,962 | A | 1/2000 | Beaton |
| 6,024,635 | A | 2/2000 | Cruickshank et al. |
| 6,033,295 | A | 3/2000 | Fisher et al. |
| 6,039,641 | A | 3/2000 | Sung |
| 6,192,875 | B1 | 2/2001 | Koroku et al. |
| 6,193,770 | B1 | 2/2001 | Sung |
| 6,273,082 | B1 | 8/2001 | Tselesin |
| 6,286,498 | B1 | 9/2001 | Sung |
| D458,948 | S | 6/2002 | Chianese et al. |
| D459,375 | S | 6/2002 | Chianese et al. |
| D459,376 | S | 6/2002 | Chianese et al. |
| D459,740 | S | 7/2002 | Chianese et al. |
| 6,453,899 | B1 | 9/2002 | Tselesin |
| 6,458,471 | B2 | 10/2002 | Lovato et al. |
| 6,482,244 | B2 | 11/2002 | Tselesin |
| 6,485,533 | B1 | 11/2002 | Ishizaki et al. |
| 6,752,709 | B1 | 6/2004 | Skibo et al. |
| 6,755,729 | B2 | 6/2004 | Ramanath et al. |
| 6,817,936 | B1 | 11/2004 | Skeem et al. |
| 6,827,072 | B2 | 12/2004 | Schwammle |
| 6,872,133 | B2 | 3/2005 | Lee et al. |
| 6,878,051 | B2 | 4/2005 | Brach |
| 6,935,940 | B2 | 8/2005 | Skeem et al. |
| 7,210,474 | B2 | 5/2007 | Gaida et al. |
| 7,444,914 | B2 | 11/2008 | Brach |
| 7,879,129 | B2 | 2/2011 | Kosters et al. |
| 7,946,907 | B2 | 5/2011 | Heyen |
| 8,591,295 | B2 | 11/2013 | Gosamo et al. |
| 8,597,088 | B2 * | 12/2013 | Hoang et al. ..... 451/540 |
| 2001/0023558 | A1 | 9/2001 | Tselesin |
| 2001/0025457 | A1 | 10/2001 | Tselesin |
| 2002/0129807 | A1 | 9/2002 | Cervantes |
| 2003/0213483 | A1 | 11/2003 | Sakarcan |
| 2003/0232586 | A1 | 12/2003 | Ramanath et al. |
| 2005/0235978 | A1 | 10/2005 | Kim et al. |
| 2005/0279533 | A1 | 12/2005 | Corica |
| 2006/0160476 | A1 | 7/2006 | Bright et al. |
| 2006/0185492 | A1 | 8/2006 | Chianese |
| 2007/0099548 | A1 | 5/2007 | Kumar et al. |
| 2008/0066969 | A1 | 3/2008 | Paul-Philippe |
| 2008/0076338 | A1 | 3/2008 | Andrews et al. |
| 2008/0153402 | A1 | 6/2008 | Arcona et al. |
| 2009/0199692 | A1 | 8/2009 | Heyen |
| 2009/0199693 | A1 | 8/2009 | Heyen |
| 2010/0035530 | A1 | 2/2010 | Gosamo et al. |
| 2010/0200304 | A1 | 8/2010 | Gosamo et al. |
| 2010/0248600 | A1 | 9/2010 | Chianese et al. |
| 2010/0279138 | A1 | 11/2010 | Zheng |
| 2011/0023911 | A1 | 2/2011 | Lenkeit et al. |

FOREIGN PATENT DOCUMENTS

| | | | |
|---|---|---|---|
| CN | 1572451 | A | 2/2005 |
| CN | 201295881 | Y | 8/2009 |
| DE | 19650718 | A1 | 6/1998 |
| EP | 0917939 | A1 | 5/1999 |
| EP | 0925378 | B1 | 4/2002 |
| EP | 0871562 | B1 | 1/2003 |
| EP | 2075092 | A2 | 7/2009 |
| FR | 2532875 | A1 | 3/1984 |
| GB | 822058 | A | 10/1959 |
| GB | 2086822 | | 5/1982 |
| GB | 2086823 | | 5/1982 |
| GB | 2086824 | | 5/1982 |
| JP | 51121880 | A | 10/1976 |
| JP | S60178568 | U | 11/1985 |
| JP | 6268764 | U | 4/1987 |
| JP | 01246077 | A | 10/1989 |
| JP | H02160475 | A | 6/1990 |
| JP | 03-060981 | A | 3/1991 |
| JP | 8066869 | A | 3/1996 |
| JP | 3034101 | A | 11/1996 |
| JP | H08323631 | A | 12/1996 |
| JP | 11-000915 | A | 1/1999 |
| JP | 2000061932 | A | 2/2000 |
| JP | 2001038718 | A | 2/2001 |
| JP | 2001527469 | A | 12/2001 |
| JP | 2002028856 | A | 1/2002 |
| JP | 2002079469 | A | 3/2002 |
| JP | 2002530212 | A | 9/2002 |
| JP | 2003011113 | A | 1/2003 |
| JP | 2003011115 | A | 1/2003 |
| JP | 3092359 | U | 3/2003 |
| JP | 2003103410 | A | 4/2003 |
| JP | 2004524170 | A | 8/2004 |
| JP | 200790565 | A | 4/2007 |
| JP | 2007136817 | A | 6/2007 |
| JP | 2007517675 | A | 7/2007 |
| JP | 2007216306 | A | 8/2007 |
| JP | 2009078055 | A | 4/2009 |
| JP | 2011530417 | A | 12/2011 |
| KR | 10-0263787 | B1 | 5/2000 |
| RU | 410955 | | 1/1974 |
| RU | 799956 | | 1/1981 |
| RU | 1175724 | | 8/1985 |
| SU | 844258 | A1 | 7/1981 |
| WO | 9810110 | A1 | 3/1998 |
| WO | 98/24593 | A1 | 6/1998 |
| WO | 9857771 | | 12/1998 |
| WO | 0030808 | A1 | 6/2000 |
| WO | 0245907 | A2 | 6/2002 |
| WO | 2006031044 | A1 | 3/2006 |
| WO | 2010016959 | A2 | 2/2010 |
| WO | 2010097223 | A1 | 9/2010 |
| WO | 2010118440 | A2 | 10/2010 |
| WO | 2011029106 | A2 | 3/2011 |

OTHER PUBLICATIONS

Norton, "Silencio" Clipper, 2010, pp. 28-29.

Norton, Saint-Gobain, "Silencio" Clipper, 2011, pp. 28-29.

Norton, Saint-Gobain, "Silencio" Clipper, 2012, pp. 24-25.

Norton, Saint-Gobain Abrasives, "Technical and Sales Argumentation" 2008, 12 pages.

(56) References Cited

OTHER PUBLICATIONS

Norton, Saint-Gobain Abrasives S.A., "Silencio" EN13236, 2011, 2 pages.
Norton, Saint-Gobain Abrasives, "Silencio—Product Sheet", 2009, 1 page.
Hilti, "A breakthrough in speed", Hilti DD-B Series Core Bits, 2001, Hilti Corporation, http://hilti.com, 7 pages.
International Search Report for PCT/US2010/023807 dated Sep. 30, 2010, 7 pgs.
International Search Report for PCT/US2009/043356 dated Apr. 12, 2010, 8 pgs.
International Search Report for PCT/US2010/062633 dated Sep. 27, 2011, 6 pgs.
International Search Report for PCT/US2010/041858 dated Aug. 17, 2011, 10 pgs.
U.S. Appl. No. 12/703,407, filed Feb. 10, 2010, Inventors: Ignazio Gosamo et al.
U.S. Appl. No. 12/463,228, filed May 8, 2009, Inventors: Ignazio Gosamo et al.
U.S. Appl. No. 13/180,991, filed Jul. 12, 2011, Inventors: Ignazio Gosamo et al.
Office Action dated Oct. 8, 2012 from Russian Application No. 2011137203, 3 pages.
Office Action dated Dec. 18, 2012 from Japanese Patent Application No. 2011-522075, 4 pages.
Beijing 152 Factory, A new method of making diamond abrasive tools, Aug. 29, 1974, Non-metallic minerals, pp. 62-64, vol. 4.
Shi Xingkuan, et al., The Function of Wheel Infiltrant and Its Suitable Selection, Tool Engineering, Sep. 22, 1995, pp. 23-26, vol. 29, Issue 9.

* cited by examiner

ABRASIVE ARTICLE INCORPORATING AN INFILTRATED ABRASIVE SEGMENT

CROSS-REFERENCE TO RELATED APPLICATION(S)

This application is a continuation and claims priority to U.S. patent application Ser. No. 12/983,075 entitled "Abrasive Article Incorporating an Infiltrated Abrasive Segment," by Marc L. Hoang, Ignazio Gosamo and André R. G. Heyen, filed Dec. 31, 2010, which application claims priority under 35 U.S.C. §119(e) to U.S. Patent Application No. 61/291,785 entitled "Abrasive Article Incorporating an Infiltrated Abrasive Segment" by Marc L. Hoang and André R. G. Heyen, filed Dec. 31, 2009, of which both applications are assigned to the current assignee hereof and incorporated by reference in their entirety.

BACKGROUND

1. Filed of the Disclosure

The following is generally directed to abrasive tools and processes for forming same, and more particularly, to abrasive tools utilizing infiltrated abrasive segments attached to a base and methods of assembling such tools.

2. Description of the Related Art

Tools necessary for furthering infrastructure improvements, such as building additional roads and buildings, are vital to the continued economic expansion of developing regions. Additionally, developed regions have a continuing need to replacing aging infrastructure with new and expanded roads and buildings.

The construction industry utilizes a variety of tools for cutting and grinding of construction materials. Cutting and grinding tools are required for to remove or refinish old sections of roads. Additionally, quarrying and preparing finishing materials, such as stone slabs used for floors and building facades, require tools for drilling, cutting, and polishing. Typically, these tools include abrasive members bonded to a base element, such as a plate or a wheel. Breakage of the bond between the abrasive member and the base element can require replacing the abrasive member and/or the base element, resulting in down time and lost productivity. Additionally, the breakage can pose a safety hazard when portions of the abrasive member are ejected at high speed from the work area. As such, improved bonding between the abrasive member and the base element is desired.

SUMMARY

According to one aspect, an abrasive article includes a base and an abrasive member including abrasive particles bound to a metal matrix, the abrasive member having a network of interconnected pores substantially filled with an infiltrant comprising a metal infiltrant material. The abrasive article further includes a backing region between the abrasive member and the base, the backing region made of a bonding composition including at least one metal element, the backing region being a region distinct from the base and a region distinct from the abrasive member. The abrasive article has an average break strength at the backing region of at least about 600 N/mm$^2$ and a break strength variation of not greater than about 150.

In another aspect, an abrasive article as a base, an abrasive member comprising three distinct phases bonded to each other including abrasive particles, a metal matrix, and an infiltrant, and a backing region between the abrasive member and the base. The backing region includes a first phase and a second phase, wherein the first phase and the second phase are substantially uniformly distributed within each other and wherein the first phase and the second phase are comprised of discrete regions, wherein the discrete regions have an average size of not greater than about 50 microns.

According to yet another aspect, an abrasive article includes a base and an abrasive member including abrasive particles bound to a metal matrix, the abrasive member further comprising a network of interconnected pores substantially filled with an infiltrant comprising a metal infiltrant material. The abrasive article further includes a backing region between the abrasive member and the base, the backing region formed of a bonding composition including at least one metal element, the backing region being a region distinct from the base and a region distinct from the abrasive member. The abrasive article has an average cut speed of at least about 1000 cm$^2$/min for 50 cuts through a paving slabs made of concrete and having a thickness of 4 cm and a length of 30 cm.

In still another aspect, an abrasive article includes a base, an abrasive member comprising three distinct phases bonded to each other including abrasive particles, a metal matrix, and an infiltrant, and a backing region between the abrasive member and the base, wherein the backing region comprises a laser welded bond joint.

According to one aspect, a method of forming an abrasive article includes placing an abrasive member on a base, wherein the abrasive member comprises abrasive particles bound to a metal matrix, and further comprising a network of interconnected pores substantially filled with an infiltrant comprising a metal infiltrant material. The method further includes welding the abrasive member to the base.

In still another aspect, an abrasive article includes a base, an abrasive member including abrasive particles bound to a metal matrix, the abrasive member further comprising a network of interconnected pores substantially filled with an infiltrant comprising a metal infiltrant material, a backing region between the abrasive member and the base, the backing region comprising a network of interconnected pores substantially filled with an infiltrant comprising a metal infiltrant material, and a welding joint at the backing region bonding the base and the abrasive member together.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

According to an embodiment, the abrasive articles herein can include a base element and an abrasive member. The abrasive article can be a cutting tool for cutting construction materials, such as a saw for cutting concrete. Alternatively, the abrasive article can be a grinding tool such as for grinding concrete or fired clay or removing asphalt.

Figure 1:
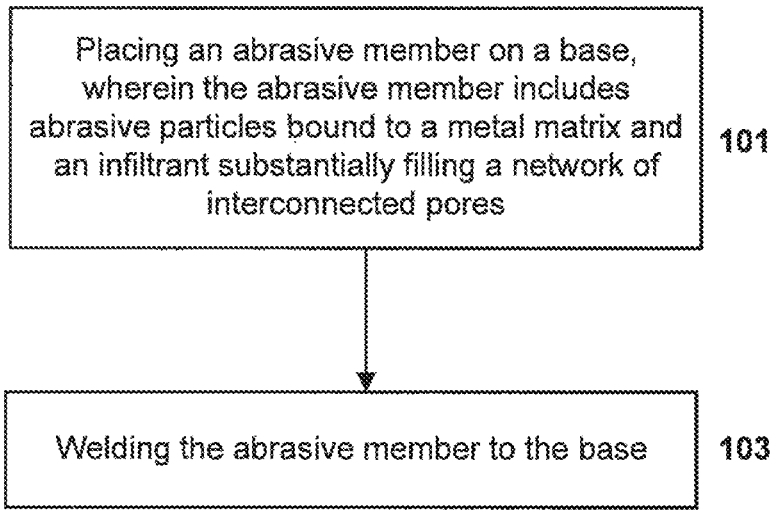
FIG. 1 includes a flow chart of a method of forming an abrasive article in accordance with an embodiment.

FIG. 1 includes a flow chart providing a method of forming an abrasive article according to an embodiment. As illustrated, the process can be initiated at step 101 by placing an abrasive member on a base. It will be appreciated that the abrasive member can be initially formed before being placed on the base for attachment. In particular, the abrasive member can be an infiltrated abrasive segment having abrasive particles bound to a metal matrix, and further comprising a network of interconnected pores, wherein at least a portion of the pores are filled with an infiltrant made of a metal infiltrant material.

The base element can be in the form of a ring, a ring section, a plate, or a disc depending upon the intended application of the abrasive article. The base element can be made of a metal or metal alloy. For instance, the base can be made of a steel, and particularly, a heat treatable steel alloys, such as 25CrMo4, 75Cr1, C60, or similar steel alloys for base elements with thin cross sections or simple construction steel like St 60 or similar for thick base elements. The base element can have a tensile strength of at least about 600 $N/mm^2$ The base element can be formed by a variety of metallurgical techniques known in the art.

Notably, the base material can be a low-carbon type material, which will facilitate a welding process according to embodiments herein. The base material can have less than about 10% carbon content, such as less than about 8%, less than about 6%, less than about 4%, less than about 2%, and even less than about 1%, to facilitate the forming process.

In an exemplary embodiment, an abrasive member includes abrasive particles embedded in a metal matrix having a network of interconnected pores. The abrasive particles can include an abrasive material having a Mohs hardness of at least about 7. In particular instances, the abrasive particles can include a superabrasive material, such as diamond or cubic boron nitride. The abrasive particles can have a particle size of not less than about 400 US mesh, such as not less than about 100 US mesh, such as between about 25 and 80 US mesh. Depending on the application, the size can be between about 30 and 60 US mesh.

The abrasive particles can be present in an amount between about 2 vol % to about 50 vol %. Additionally, the amount of abrasive particles may depend on the application. For example, an abrasive member for a grinding or polishing tool can include between about 3.75 vol % and about 50 vol % abrasive particles of the total volume of the abrasive member. Alternatively, an abrasive member for a cutting-off tool can include between about 2 vol % and about 6.25 vol % abrasive particles of the total volume of the abrasive member. Further, an abrasive member for core drilling can include between about 6.25 vol % and about 20 vol % abrasive particles of the total volume of the abrasive member.

The metal matrix can include a metal element or metal alloy including a plurality of metal elements. For certain abrasive segments, the metal matrix can include metal elements such as iron, tungsten, cobalt, nickel, chromium, titanium, silver, and a combination thereof. In particular instances, the metal matrix can include a rare earth element such as cerium, lanthanum, neodymium, and a combination thereof.

In one particular example, the metal matrix can include a wear resistant component. For example, in one embodiment, the metal matrix can include tungsten carbide, and more particularly, may consist essentially of tungsten carbide.

In certain designs, the metal matrix can include particles of individual components or pre-alloyed particles. The particles can be between about 1.0 micron and about 250 microns.

As noted above, the abrasive member can be formed such that an infiltrant is present within the interconnected network of pores within the body of the abrasive member. The infiltrant can partially fill, substantially fill, or even completely fill the volume of the pores extending through the volume of the abrasive member. In accordance with one particular design, the infiltrant can be a metal or metal alloy material. For example, some suitable metal elements can include copper, tin, zinc, and a combination thereof.

In particular instances, the infiltrant can be a bronzing material made of a metal alloy, and particular a copper-tin metal alloy, such that it is particularly suited for welding according to embodiments herein. For example, the bronzing material can consist essentially of copper and tin. Certain bronzing materials can incorporate particular contents of tin, such as not greater than about 20%, not greater than about 15%, not greater than about 12%, or even not greater than about 10% of the total amount of materials within the composition. In accordance with an embodiment, the bronzing material can include an amount of tin within a range between about 5% and about 20%, such as between about 8% and about 15%, or even between about 8% and about 12%.

Moreover, certain bronzing materials can be used as infiltrant material, and can have an amount of copper of at least about 80%, at least about 85%, or even at least about 88% of the total amount of materials within the composition. Some bronzing materials can utilize an amount of copper within a range between about 80% and about 95%, such as between about 85% and about 95%, or even between about 88% and about 93%.

Additionally, the bronzing material may contain a particularly low content of other elements, such as zinc to facilitate proper formation of the abrasive article according to the forming methods of the embodiments herein. For example, the bronzing material may utilize not greater than about 10%, such as not greater than about 5%, or even not greater than about 2% zinc. In fact, certain bronzing materials can be essentially free of zinc.

The abrasive member may be manufactured, such that abrasive particles can be combined with a metal matrix to form a mixture. The metal matrix can include a blend of particles of the components of the metal matrix or can be pre-alloyed particles of the metal matrix. In an embodiment, the metal matrix can conform to the formula $(WC)_w W_x Fe_y Cr_z X_{(1-w-x-y-z)}$, wherein $0 \le w \le 0.8$, $0 \le x \le 0.7$, $0 \le y \le 0.8$, $0 \le z \le 0.05$, $w+x+y+z \le 1$, and X can include other metals such as cobalt and nickel. In another embodiment, the metal matrix can conform to the formula $(WC)_w W_x Fe_y Cr_z Ag_v X_{(1-v-w-x-y-z)}$, wherein $0 \le w \le 0.5$, $0 \le x \le 0.4$, $0 \le y \le 1.0$, $0 \le z \le 0.05$, $0 \le v \le 0.1$, $v+w+x+y+z \le 1$, and X can include other metals such as cobalt and nickel.

The mixture of metal matrix and abrasive particles can be formed into an abrasive preform by a pressing operation, particularly a cold pressing operation, to form a porous abrasive member. The cold pressing can be carried out at a pressure of between about 50 $kN/cm^2$ (500 MPa) to about 250 $kN/cm^2$ (2500 MPa). The resulting porous abrasive member can have a network of interconnected pores. In an example, the porous abrasive member can have a porosity between about 25 and 50 vol %.

The resulting porous abrasive member can then be subject to an infiltration process, wherein the infiltrant material is disposed within the body of the abrasive member, and particularly, disposed within the interconnected network of pores within the body of the abrasive member. The infiltrant may be drawn into the pores of the cold pressed abrasive member via capillary action. After the infiltration process, the resulting densified abrasive member can be not less than about 96% dense. The amount of infiltrant that infiltrates the abrasive member can be between about 20 wt % and 45 wt % of the densified abrasive member.

The abrasive member can include a backing region, disposed between the abrasive member and the base, which facilitates the joining of the abrasive member and the base. According to one embodiment, the backing region can be a distinct region from the abrasive member and the base. Still, the backing region can be initially formed as part of the abrasive member, and particularly may be a distinct region of the abrasive member that has particular characteristics facilitating the joining of the abrasive member and the base. For example, according to one embodiment, the backing region can have a lesser percentage (vol %) of abrasive particles as compared to the amount of abrasive particles within the abrasive member. In fact, in certain instances, the backing region can be essentially free of abrasive particles. This may be particularly suitable for forming methods utilizing a beam of energy (e.g., a laser) used to weld the abrasive member to the base.

At least a portion of the backing region can include a bonding composition. The bonding composition can include a metal or metal alloy. Some suitable metal materials can include transition metal elements, including for example, titanium, silver, manganese, phosphorus, aluminum, magnesium, chromium, iron, lead, copper, tin, and a combination thereof.

In particular instances, the bonding composition can be similar to the infiltrant, such that the bonding composition and the infiltrant are different from each other by not greater than a single elemental species. In even more particular instances, the bonding composition can be the same as the infiltrant. For example, the bonding composition can be a bronzing material, and more particularly, can consist essentially of a bronzing material as described herein.

According to embodiments herein, the bonding composition can be related to the infiltrant composition in having a certain degree of commonality of elemental species. Quantitatively, an elemental weight percent difference between the bonding composition and the infiltrant composition may not be greater than about 20 wt %. Elemental weight percent difference is defined as the absolute value of the difference in weight content of each element contained in the bonding composition relative to the infiltrant composition. Other embodiments have closer compositional relationships between the bonding composition and the composition of the infiltrant. The elemental weight percent difference between the bonding composition and the infiltrant composition may, for example, not exceed 15 wt %, 10 wt %, 5 wt %, or may not exceed 2 wt %. An elemental weight percent difference of about zero represents the same composition making up the backing region and the infiltrant. The foregoing elemental values may be measured by any suitable analytical means, including microprobe elemental analysis, and ignores alloying that might take place along areas in which the infiltrant contacts the metal matrix.

The backing region can have a particular content of porosity. For example, the backing region can have a porosity that is less than the porosity of the abrasive member. In fact, the amount of porosity in the backing region can be significantly less as compared to the amount of porosity within the abrasive member. In some cases, the backing region comprises at least 2% less porosity as compared on a volume percent basis between the two regions. In other instances, the difference can be greater, such as at least about 4% less porosity, at least about 5% less, at least about 7% less, at least about 10% less, or even at least about 15% less porosity than the abrasive member. The difference in porosity can facilitate proper infiltration of the backing region and abrasive member.

The backing region can have not greater than about 40 vol % porosity for the total volume of the backing region. In other instances, the amount of porosity within the backing region can be not greater than about 38 vol %, not greater than about 34 vol % or even not greater than about 30 vol %. Still, the amount of porosity within the backing region can be at least about 7 vol %, at least about 8 vol %, at least about 10 vol %, at least about 12 vol %, or even at least about 15 vol % infiltrant. The porosity content of the backing region can be within a range between any of the minimum and maximum percentages noted above.

It will further be appreciated that a significant portion of the total porosity within the backing region can be interconnected porosity. That is, at least a majority, or even at least about 75%, at least about 80%, at least about 90%, at least about 95%, or essentially all of the porosity can be interconnected porosity.

The backing region can include at least about 5 vol % infiltrant for the total volume of the backing region. In other instances, the backing region can include at least about 7 vol %, at least about 8 vol %, at least about 10 vol %, at least about 12 vol %, or even at least about 15 vol % infiltrant. Still, the amount of infiltrant can be limited, such that it is not greater than about 40 vol %, not greater than about 38 vol %, not greater than about 34 vol % or even not greater than about 30 vol %. The amount of infiltrant can be within a range between any of the minimum and maximum percentages noted above.

Accordingly, the backing region can include a network of interconnected pores formed between a matrix metal, and wherein the infiltrant material substantially fills the interconnected pores. The backing region can contain similar amounts of matrix metal and infiltrant. Notably, the backing region may be essentially free of abrasive particles. In such embodiments wherein the backing region includes interconnected pores substantially filled with the infiltrant, the infiltrant material can act as a bronzing material in forming a joint (e.g., a welded joint) between the base and the abrasive member.

Accordingly, the formation the backing region, and particularly, control of the nature and size of porosity within the backing region can be controlled to facilitate proper infiltration. Proper infiltration ensures proper material characteristics of the backing region and formation of a suitable welding joint region between the backing region and the base. For example, the backing region is formed such that the average pore size of the pores within the backing region are not greater in size, and more particularly smaller in size, than the average pore size of the pores within the abrasive member. Such a distinction can facilitate full and proper infiltration of the backing region and formation of a strong welding joint region.

In certain instances, the average pore size of the pores within the backing region is at least about 1% smaller than the average pores size of the pores within the abrasive member. In other embodiments, the difference in average pore size can be greater, such as at least about 3%, at least about 5%, at least about 10%, or even at least about 20% smaller. Still, the difference can be limited, such that it is not greater than about 80%, not greater than about 70%, not greater than about 50%, or even not greater than about 40%. The difference in average pore size can be within a range between any of the minimum and maximum values.

Control of the nature and size of the porosity within the abrasive member and the backing region can include the application of highly uniform application of pressure during formation of the abrasive article including the abrasive member and the backing region. The uniform pressure across the entire length and volume of the two components can facilitate homogenous compression of the bodies and substantially uniform pore sizes. Powder sizes of the powder material used to form the abrasive member and backing region may be particularly selected to further control the pore size.

In one embodiment, the backing region can include a particular bronzing material that facilitates a welding operation to join the abrasive member and the base. In fact, certain backing regions can consist essentially of a copper-tin bronzing material. Some suitable bronzing materials can include at least about 80% copper, such as at least about 82% copper, at least about 85% copper, at least about 87% copper, at least about 88% copper, at least about 90% copper, at least about 93% copper, or even at least about 95% copper. As such, the bronzing material can include a balance amount of tin, such that suitable bronzing materials can include not greater than about 20% tin, not greater than about 18% tin, not greater than about 15% tin, not greater than about 13% tin, not greater than about 12% tin, not greater than about 10% tin, not greater than about 8% tin, not greater than about 5% tin.

After placing the abrasive member on the base at step 101, the process can continue at step 103 by welding the abrasive member to the base. In particular instances the welding process includes impinging a beam of energy at the base, and more particularly, can include impinging a beam of energy at the backing region between the abrasive member and the base. In particular instances, the beam of energy can be a laser, such that the abrasive segment is attached to the base via a laser welded bond joint. The laser may be a Roffin laser source commonly available from Dr. Fritsch.

Figure 2:
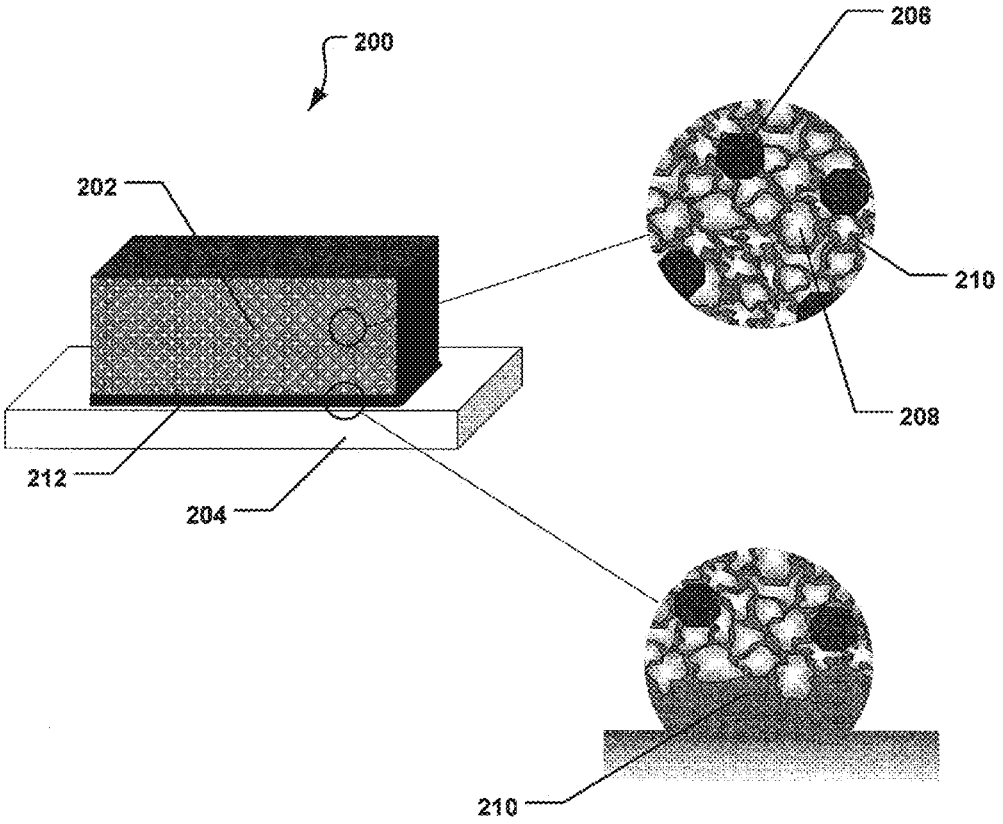
FIG. 2 includes an illustration of an abrasive article in accordance with an embodiment.

FIG. 2 illustrates an exemplary abrasive article 200 including a densified abrasive member 202 bonded to a base 204. The densified abrasive member 202 includes metal matrix particles 206 and abrasive particles 208 bonded to each other, and an interconnected network of pores extending between the metal matrix particles 206 that is filled with an infiltrant 210. As further illustrated, the abrasive article can include a backing region 212 disposed between the abrasive member 202 and the base 204. The backing region 212 can include a bonding composition that can be continuous with the composition of the densified abrasive member 202.

Figure 3A:
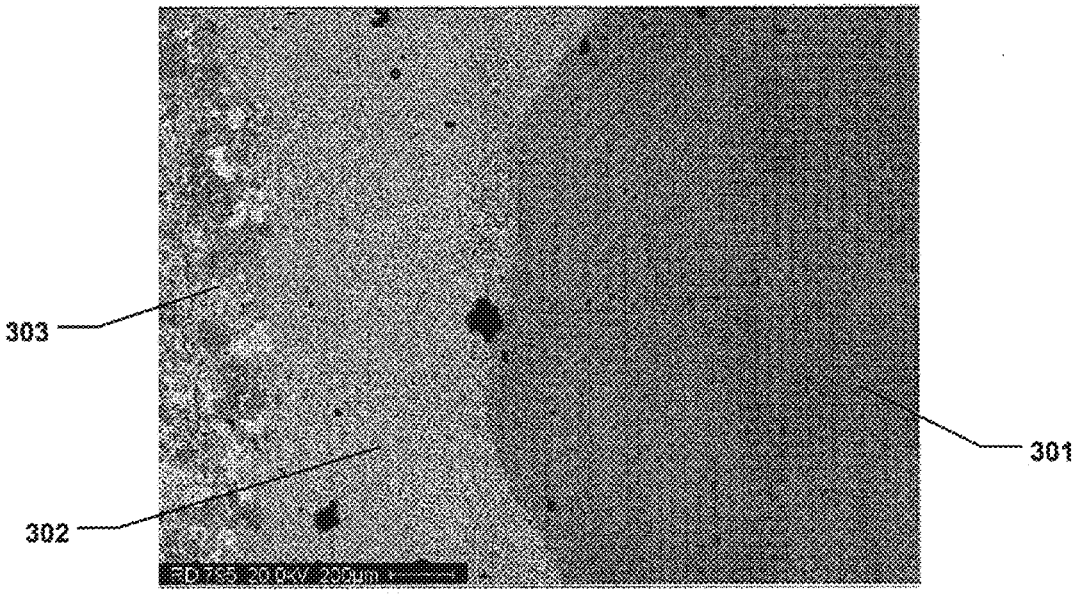
FIGS. 3A and 3B include cross-sectional images of portion of an abrasive article including a portion of a backing region in accordance with an embodiment.
Figure 3B:
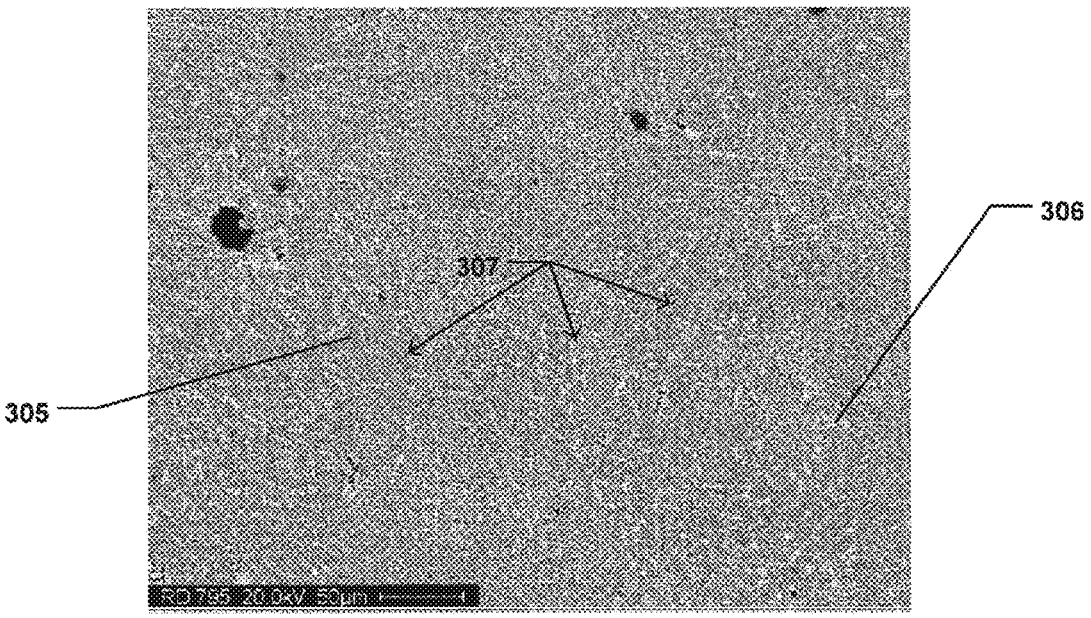

In accordance with one embodiment, the backing region of the abrasive article is formed such that the backing region 212 can include a first phase and a second phase uniformly distributed within each other. FIGS. 3A and 3B include cross-sectional images of portion of an abrasive article including a portion of a backing region in accordance with an embodiment. As illustrated, the image of FIG. 3A includes a portion of a base 301, a portion of a backing region 302, and a portion of an abrasive segment 303. As further illustrated in FIG. 3B, the backing region 302 can include discrete phases, particularly a first phase 305 and a second phase 306 that are substantially uniformly intermixed.

Moreover, the first phase 305 and the second phase 306 can have discrete regions as illustrated in the magnified image. The discrete regions can be polycrystalline regions that have an average size of not greater than about 50 microns as measured along the longest dimension in a similiary magnified image. This may be facilitated by the use of a metal material having a particular average powder size and having a substantially spherical shape. In certain embodiments, the discrete regions of the first and second phases 305 and 306 can be smaller, such as on the order of not greater than about 40 microns, not greater than about 30 microns, not greater than about 25 microns, or even not greater than about 20 microns. In particular instances, the discrete regions of the first and second phases 305 and 306 can have an average size within a range between about 1 micron and about 50 microns, such as between about 5 microns and about 50 microns, such as between about 10 microns and about 40 microns, or even between about 10 microns and about 30 microns.

As illustrated, the first and second phases 305 and 306 can be finely intermixed with each other and finely marbled. Moreover, the distinct regions identifying the first phase 305 can be defined by an elongated, fibrous, and/or dendritic morphology, wherein fibrous strands can extend through the second phase 306 and even become intertwined with each other.

Additionally, the backing region 302 can include fine closed pores 307, which may be uniformly spaced apart from each other throughout the entire volume of the backing region 302. In particular instances, the closed pores 307 can have particularly rounded shapes, and generally, the average pore size is less than about 50 microns, such as less than about 40 microns, less than about 25 microns, or even less than about 15 microns.

The backing region can have an average thickness of not greater than about 400 microns, such as on the order of not greater than about 300 microns, not greater than about 200 microns. The average backing region may be measured by taking at least about 10 different measurements using magnified images such as illustrated in FIG. 3A along a length of the interface of the backing region and abrasive member of at least about 1 mm In other instances, the backing region 302 can be formed to have an average thickness of at least about 50 microns, such as at least about 100 microns, at least about 150 micron, or even at least about 175 microns. Still, particular designs may utilize a backing region having an average thickness within a range between about 50 microns and about 400 microns, such as between about 100 microns and about 300 microns.

Figure 4:
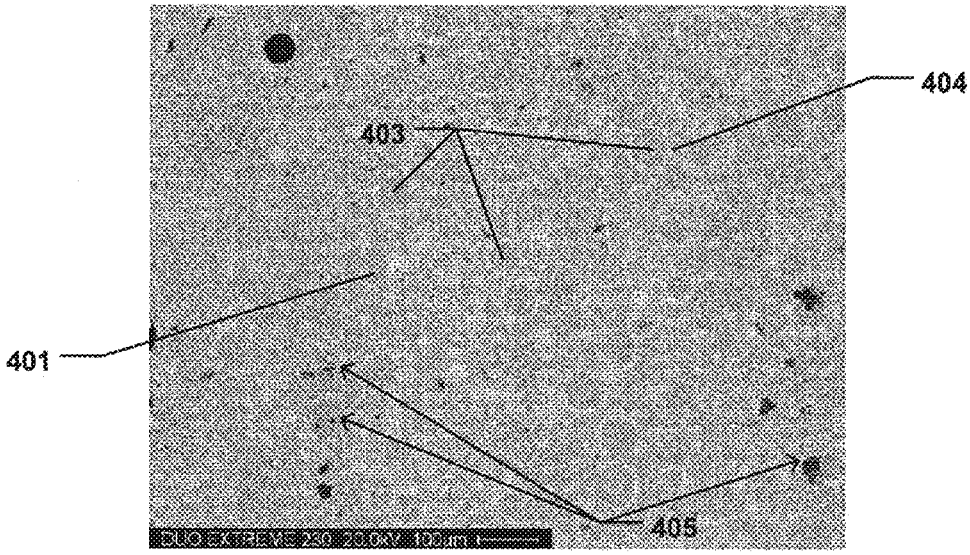
FIG. 4 includes a cross-sectional image of a conventional hot pressed abrasive article having a backing region exhibiting stones.

Moreover, the backing region 302 can be essentially free of stones, which may be common in more conventional abrasive articles (e.g., hot pressed abrasive segments bonded to the base via welding). Stones are generally identified as regions of non-homogenous composition as compared to the surrounding region, and can present regions that are more prone to induce failure of fracture through the region. FIG. 4 includes a cross-sectional image of a conventional abrasive article having a backing region 401 exhibiting stones 403, which are present as large and rounded particles that are surrounded by a distinct, second phase 404. Moreover, the backing region 401 exhibits pores 405 that are not uniformly dispersed throughout the volume of the backing region, but are concentrated in particular regions, such as in regions proximate to the stones403, a and even more particularly, at the interfaces between the stones 403 and the distinct second phase 404 surrounding the stones 403.

Abrasive article formed according to embodiments herein may have particular mechanical characteristics, and particularly suitable strength of bonds and consistency in the strength of bonds between the abrasive segment and the base as measured at the backing region. For example, according to one embodiment, the abrasive article can have an average break strength at the backing region of at least about 600 $N/mm^2$, which can be measured according to European standard testing procedures outlined in EN13236. In certain instances, the average break strength can be at least about 600 $N/mm^2$, such as at least about 700 $N/mm^2$, at least about 800

$N/mm^2$, at least about 925 $N/mm^2$, such as at least about 950 $N/mm^2$, or even at least about 975 $N/mm^2$ In still more particular embodiments, the abrasive article can have an average break strength within a range between about 600 $N/mm^2$ and about 1400 $N/mm^2$, between about 700 $N/mm^2$ and about 1400 $N/mm^2$, and even between about 800 $N/mm^2$ and about 1400 $N/mm^2$ In certain embodiments, the abrasive article can have an average break strength with a range between about 900 $N/mm^2$ and about 1400 $N/mm^2$, such as between about 925 $N/mm^2$ and about 1350 $N/mm^2$, between about 950 $N/mm^2$ and about 1300 $N/mm^2$, or even between about 975 $N/mm^2$ and about 1250 $N/mm^2$.

Moreover, the abrasive articles of embodiments herein can exhibit consistent break strength as measured by the break strength variation, which is calculated as the standard deviation of at least 100 measurements. The abrasive articles of the embodiments herein can have a break strength variation of not greater than about 150, such as not greater than about 125, not greater than about 120, or even not greater than about 110. In certain instances, the break strength variation can be within a range between about 25 and about 150, such as between about 25 and about 125, or even between about 25 and about 110.

The abrasive articles of embodiments herein can have certain performance features. For example, the abrasive articles can have an average cut speed of at least about 1000 $cm^2$/min for 50 cuts through a paving slabs made of concrete aggregate used in paving roads and having a thickness of 4 cm and a length of 30 cm. In fact, certain abrasive articles can have an average cut speed of at least about 1050 $cm^2$/min, such as at least about 1100 $cm^2$/min, or even at least about 1125 $cm^2$/min Particular embodiments herein may utilize and abrasive article having an average cut speed within a range between about 1000 $cm^2$/min and about 1400 $cm^2$/min, such as between about 1050 $cm^2$/min and about 1400 $cm^2$/min, or even between about 1100 $cm^2$/min and about 1300 $cm^2$/min

EXAMPLES

Four samples are formed and tested. Sample 1 is an infiltrated part formed initially through cold pressing at approximately 1000 MPa, and thereafter infiltrated with a particular bronze material. The abrasive member includes a tungsten carbide-based metal matrix (may include other metals of cobalt and nickel) and abrasive particles of diamond. The abrasive article of sample 1 also includes a backing region that is essentially free of abrasive particles. The infiltrant is a 80/20 copper/tin bronze material having an average particle size of less than about 45 microns.

Sample 2 is formed according to the process of sample 1, except that the bronze material is a 85/15 copper/tin bronze material having an average particle size of less than 63 microns.

Sample 3 is formed according to the process of sample 1, except that the bronze material is a 90/10 copper/tin bronze material having an average particle size of less than 45 microns.

Sample 4 is formed according to the process of sample 1, except that the bronze material is a 95/5 copper/tin bronze material having an average particle size of less than 74 microns.

Speed and life tests were conducted on Samples 1-4, the results of which are summarized in Table 1 below.

TABLE 1

| | Sample 1 | Sample 2 | Sample 3 | Sample 4 |
|---|---|---|---|---|
| Speed ($cm^2$/min) | 960 | 1029 | 864 | 900 |
| Life ($m^2$/mm) | 0.387 | 0.492 | 0.527 | 0.373 |

As noted above, the speed of cutting and life of the abrasive articles formed according to samples 1-4 demonstrated industry standard capabilities. The speed for samples 1-4 was greater than certain conventional industry standard hot pressed pieces. The life was also improved as compared to certain conventional articles.

Furthermore, many parts were formed according to the samples above (Samples 1-4). In fact, 16 segments were formed for each of the samples (i.e., samples 1-4), which were laser welded to low carbon steel. The welding strength of each of the samples, and the average break strength and standard deviation are provided below in Table 2, based on the measured torque necessary to break the segment from the base.

TABLE 2

| | Sample 1 | Sample 2 | Sample 3 | Sample 4 |
|---|---|---|---|---|
| Average (N m) | 21.7 | 20.5 | 22.9 | 19.6 |
| Standard Deviation | 1.75 | 1.71 | 0.83 | 1.93 |

As can be seen, the segments for samples 1-4 demonstrated suitable average break strength for industry use. Perhaps more remarkable, is that the standard deviation for all samples tested was significantly low, particularly as compared to conventional parts, wherein the standard deviations are typically much higher.

Sample 5 and 6 are formed according to the embodiment of sample 2 above. Samples 5 and 6 each include 16 independent cold pressed and infiltrated segments that are laser welded to a low-carbon steel base. The average break strength and break strength variation are measured for each of the 16 segments for samples 5 and 6. The results are summarized below.

TABLE 3

| | Sample 5 | Sample 6 |
|---|---|---|
| Average ($N/mm^2$) | 998 | 1131 |
| Break Strength Variation | 75.7 | 106.5 |

The average break strength recorded for sample 5 and 6 meets industry standards. More particularly, the break strength variation is better than other conventional samples, which were tested and typically had values of greater than 120, if not 150. Clearly, the combination of laser welding and infiltrated abrasive articles facilitates a strongly bonded article, having a more consistent joint interface at the base, leading to fewer catastrophic failures and breakage of abrasive segments bonded to the base.

According to an embodiment, the abrasive tool includes a carrier element and an abrasive component. The abrasive tool can be a cutting tool for cutting construction materials, such as a saw for cutting concrete. Alternatively, the abrasive tool can be a grinding tool such as for grinding concrete or fired clay or removing asphalt. In particular, the following embodiments have formulated a method for the welding of infiltrated abrasive segments onto a base for use in an abrasive article. Certain references in the art have generally recognized welding as a suitable joining process. Some references have even made grand statements that an infiltrated piece may be joined to a base by a variety of processes, and randomly list welding as one of many processes. However, these references are not even remotely directed to welding of infiltrated pieces and such a process or article is not enabled by the references. The inventors of the present application, as experts in the field, note that welding of infiltrated articles is not a trivial process. Moreover, based on their knowledge, no article in the industry is based on successfully welded infiltrated parts. With the success of the abrasive article demonstrated by the Applicants, industry demand for such an article has grown. Moreover, certain problems needed to be identified and overcome in order to form a commercially successful product according to the embodiments herein. Certain combination of features lending to this success include the size and shape of the raw materials used to form the backing region, the composition of the backing region, the type, wavelength, and power of beam used for welding, the type and positioning of abrasive grains within the abrasive segment. Moreover, the abrasive segments of the embodiments herein demonstrated unexpected mechanical characteristics and performance properties.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. An abrasive article comprising:

a base;

an abrasive member including abrasive particles bound to a metal matrix, the abrasive member further comprising a network of interconnected pores substantially filled with an infiltrant comprising a metal infiltrant material;

a backing region between the abrasive member and the base, the backing region comprising a bonding composition including at least one metal element, the backing region being a region distinct from the base and a region distinct from the abrasive member; and wherein the abrasive article has an average break strength at the backing region of at least about 600 N/mm$^2$ and a break strength variation of not greater than about 150.

2. The abrasive article of claim 1, further comprising a welding joint at the backing region bonding the base and the abrasive member together.

3. The abrasive article of claim 2, wherein the infiltrant is a bronzing material configured to form the welding joint between the base and the abrasive member at the backing region.

4. The abrasive article of claim 3, wherein the bronzing material comprises an amount of tin within a range between about 5% and about 20%.

5. The abrasive article of claim 1, wherein the backing region is a separate phase from the base.

6. The abrasive article of claim 1, wherein the backing region is substantially free of abrasive grains.

7. The abrasive article of claim 1, wherein the abrasive particles are present in an amount between about 2 vol % and 50 vol % of a total volume of the abrasive member.

8. The abrasive article of claim 1, wherein the metal matrix comprises a metal selected from the group consisting of iron, tungsten, cobalt, nickel, chromium, titanium, silver, and a combination thereof.

9. The abrasive article of claim 8, wherein the metal matrix further includes a wear resistant component.

10. The abrasive article of claim 8, wherein the metal matrix further includes a rare earth element.

11. The abrasive article of claim 10, wherein the rare earth element is in an amount not greater than about 3 wt %.

12. The abrasive article of claim 1, wherein the abrasive member has a porosity of between about 25% and 50%.

13. The abrasive article of claim 1, wherein the infiltrant substantially fills the network of interconnected pores to form a densified abrasive member having a density of at least about 96% dense.

14. The abrasive article of claim 1, wherein the backing region comprises a network of interconnected pores substantially filled with the infiltrant.

15. The abrasive article of claim 14, wherein the infiltrant acts as a bronzing material for forming a joint between the base and the abrasive member at the backing region.

16. An abrasive article comprising:

a base;

an abrasive member including abrasive particles bound to a metal matrix, the abrasive member further comprising a network of interconnected pores substantially filled with an infiltrant comprising a metal infiltrant material;

a backing region between the abrasive member and the base, the backing region comprising a bonding composition including at least one metal element, the backing region being a region distinct from the base and a region distinct from the abrasive member;

wherein the abrasive article has an average break strength at the backing region of at least about 600 N/mm$^2$ and a break strength variation of not greater than about 150; and wherein the backing region comprises a first phase and a second phase, wherein the first phase and the second phase are uniformly distributed within each other and wherein the first phase and the second phase are comprised of discrete regions, wherein the discrete regions have an average size of not greater than about 50 microns.

17. The abrasive article of claim 16, wherein the backing region consists essentially of a bonding composition.

18. An abrasive article comprising:

a base;

an abrasive member including abrasive particles bound to a metal matrix, the abrasive member further comprising a network of interconnected pores substantially filled with an infiltrant comprising a metal infiltrant material;

a backing region between the abrasive member and the base, the backing region comprising a bonding composition including at least one metal element, the backing region being a region distinct from the base and a region distinct from the abrasive member;

wherein the abrasive article has an average break strength at the backing region within a range between about 600 $N/mm^2$ and about 1400 $N/mm^2$; and a break strength variation of not greater than about 150.

19. The abrasive article of claim 18, wherein the average break strength is within a range between about 975 $N/mm^2$ and about 1250 $N/mm^2$.

20. The abrasive article of claim 18, wherein the break strength variation is within a range between about 25 and about 150.

* * * * *